US009331447B2

(12) United States Patent
Charlton et al.

(10) Patent No.: US 9,331,447 B2
(45) Date of Patent: May 3, 2016

(54) CRIMPING APPARATUS HAVING A CRIMP QUALITY MONITORING SYSTEM

(75) Inventors: John D. Charlton, Harrisburg, PA (US); Keith L. Nicholas, Harrisburg, PA (US); Robert A. Dubler, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 1033 days.

(21) Appl. No.: 12/962,371

(22) Filed: Dec. 7, 2010

(65) Prior Publication Data

US 2012/0137486 A1 Jun. 7, 2012

(51) Int. Cl.
*H01R 43/048* (2006.01)

(52) U.S. Cl.
CPC ..... *H01R 43/0486* (2013.01); *Y10T 29/49185* (2015.01); *Y10T 29/49764* (2015.01); *Y10T 29/53022* (2015.01); *Y10T 29/53235* (2015.01)

(58) Field of Classification Search
CPC ..... H01R 43/0486; H01R 43/04; Y10T 29/49185; Y10T 29/53235; Y10T 29/49764; Y10T 29/53022
USPC ..... 72/21.4, 712, 20.1, 20.2
See application file for complete search history.

(56) References Cited

U.S. PATENT DOCUMENTS

| | | | | |
|---|---|---|---|---|
| 5,197,186 | A * | 3/1993 | Strong et al. | 29/863 |
| 6,161,407 | A * | 12/2000 | Meisser | 72/21.4 |
| 6,539,293 | B2 * | 3/2003 | Bachtiger et al. | 701/20 |
| 2007/0227214 | A1 * | 10/2007 | Sauerland | 72/7.6 |
| 2010/0139351 | A1 * | 6/2010 | Bruhin | 72/21.4 |

FOREIGN PATENT DOCUMENTS

| | | | |
|---|---|---|---|
| DE | 43 37 796 | A1 | 5/1995 |
| EP | 0 291 329 | A2 | 11/1988 |
| EP | 0 460 441 | A1 | 12/1991 |
| EP | 0 902 509 | A1 | 3/1999 |
| EP | 1 071 174 | A2 | 1/2001 |

OTHER PUBLICATIONS

Rauber et al., "Detection of Tool Failures in a Milling Process using Pattern Recognition Techniques", Sep. 13-15, 1995, Brazilian Symposium on Intelligent Automation.*

International Search Report, International Application No. PCT 2011/001899, International Filing Date, Nov. 15, 2011.

* cited by examiner

*Primary Examiner* — Shelley Self
*Assistant Examiner* — Mohammad I Yusuf

(57) ABSTRACT

A crimping apparatus includes a ram having crimp tooling for crimping a terminal to a wire during a crimp stroke and a force sensor detecting a crimp force during the crimp stroke. The crimping apparatus also includes a controller that monitors the crimp quality of a crimp based on a frequency profile of the crimp. Optionally, the controller may create the frequency profile based on a force profile using a frequency transform algorithm. The frequency transform algorithm may be a Fast Fourier Transform algorithm.

11 Claims, 6 Drawing Sheets

CRIMPING APPARATUS HAVING A CRIMP QUALITY MONITORING SYSTEM

BACKGROUND OF THE INVENTION

The subject matter herein relates generally to crimping apparatus, and more particularly to crimp quality monitoring systems for crimping apparatus.

Electrical terminals are typically crimped onto wires by a crimping apparatus to form a lead. The crimping apparatus has crimp tooling made up of a first part mounted to a base for supporting the electrical terminal and a second part mounted to a ram that is movable toward and away from the base for effecting the crimp. In operation, the terminal is placed on the first part of the crimp tooling, and an end of a wire is inserted into the ferrule or barrel of the terminal. The ram is caused to move toward the base through a crimp stroke, thereby crimping the terminal onto the wire.

It is desirable to, and systems have been developed that, monitor the quality of the crimp. When a defective crimp is detected, the lead is discarded. Some known crimp quality monitoring systems measure crimp quality by measuring crimp height. Ordinarily, if a terminal is not crimped to the correct crimp height for the particular terminal and wire combination, an unsatisfactory crimp connection will result. However, many unsatisfactorily crimp connections will, nevertheless, exhibit a "correct" crimp height. As such, systems that monitor crimp quality based on crimp height may pass defective leads from the crimping apparatus. Additionally, a crimp height variance or other physical variation in the crimped terminal is not, in and of itself, the cause of a defective crimp connection, but rather, may be indicative of another factor which causes the poor connection. Such factors include using the wrong terminal or wire size, missing strands of wire, short brush, insulation in the crimp, abnormal position of the terminal, wrong wire type, incorrect stripping of insulation, and the like. Since such defective crimp connections frequently have the appearance of high-quality crimp connections, it is difficult to identify these defects in order that timely corrective action may be taken.

Other known crimp quality monitoring systems detect a defectively crimped terminal by analyzing the crimping forces imposed on the terminal during the actual crimping operation. For example, the systems collect force and displacement data during the crimp stroke and compare that data with normalized data collected from known good crimps during a learning phase. Such comparison is utilized to determine whether a particular crimp meets acceptable standards. However, crimp quality monitoring systems that monitor crimp quality based on force profiles are not without problems. The systems are inaccurate at measuring certain types of defective crimps. For example, the systems are susceptible to incorrectly identifying crimps having insulation in the barrel as being good crimps. The systems also are susceptible to falsely identifying some good crimps as being defective.

A need remains for a crimp quality monitoring system that may be used to accurately identify crimp defects. A need remains for a crimp quality monitoring system that may be used to identify the particular defect with the crimp.

BRIEF DESCRIPTION OF THE INVENTION

In one embodiment, a crimping apparatus is provided that includes a ram having crimp tooling for crimping a terminal to a wire during a crimp stroke and a force sensor detecting a crimp force during the crimp stroke. The crimping apparatus also includes a controller that monitors a crimp quality of a crimp based on a frequency profile of the crimp stroke. Optionally, the controller may create the frequency profile based on a force profile using a frequency transform algorithm. The frequency transform algorithm may be a Fast Fourier Transform algorithm.

Optionally, the controller may develop a force profile based on the crimp forces detected by the force sensor, and the controller may convert the force profile to the frequency profile. The controller may analyze at least one of the force profile and the frequency profile to monitor crimp quality. The force sensor may measure the crimp force at selected intervals based on at least one of time and crimp tooling position. Optionally, the controller may determine a type of crimp defect based on the frequency profile. The controller may utilize a predetermined subset of frequencies of the frequency profile to analyze for different crimp defects. The predetermined subset of frequencies of the frequency profile may be based on the size and/or the type of wire and terminal used for the crimp. The controller may determine that a crimp is a defective crimp when a selected number of frequencies of the frequency profile are outside of the normal range of values for that frequency.

In another embodiment, a crimp quality monitoring system for a crimping apparatus is provided that includes a force sensor detecting a crimp force during a crimp stroke. The system also includes a controller operatively coupled to the force sensor. The controller has a microprocessor that utilizes force data from the force sensor to create a frequency profile for the crimp stroke using a frequency transform algorithm. The microprocessor analyzes the frequency profile to determine the quality of the crimp. Optionally, the determined quality of the crimp may be a determination as to whether a crimp is defective and/or a type of defect of the defective crimp.

In a further embodiment, a method of monitoring crimp quality is provided that includes measuring crimp forces during a crimp stroke, converting the crimp forces to a frequency profile using a frequency transform algorithm, and analyzing the frequency profile to determine a crimp quality.

DETAILED DESCRIPTION OF THE INVENTION

Figure 1:
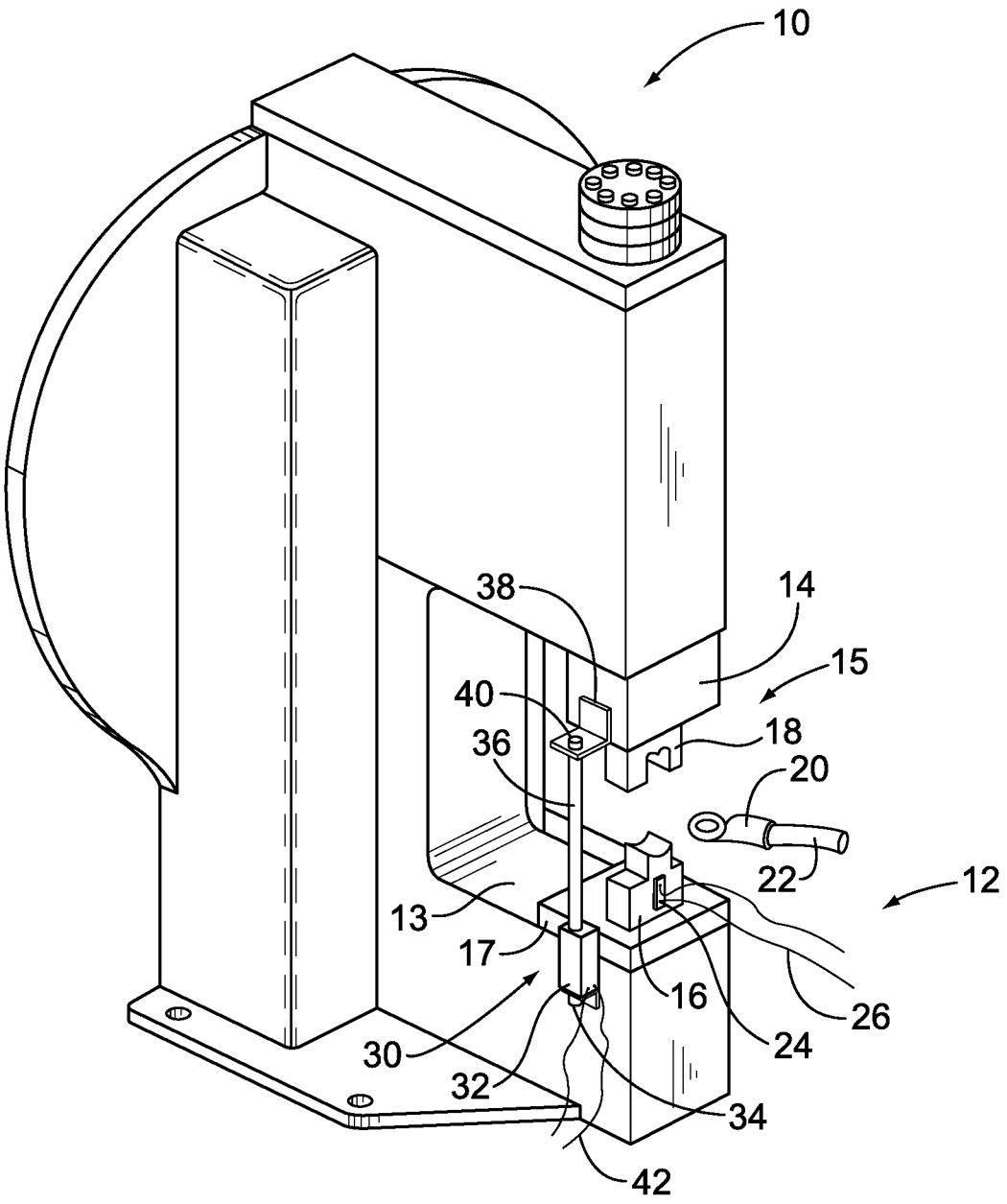
FIG. 1 illustrates an exemplary crimping apparatus having a crimp quality monitoring system formed in accordance with an exemplary embodiment.

FIG. 1 illustrates an exemplary crimping apparatus 10 having a crimp quality monitoring system 12 formed in accordance with an exemplary embodiment. The crimping apparatus 10 has a base 13 and a ram 14 arranged for reciprocating opposed motion relative to the base 13. Optionally, the crimping apparatus 10 may be of the type having a flywheel and clutch arrangement for imparting the reciprocating motion to the ram 14. However, other types of crimping apparatus having a suitable ram stroke may be used in alternative embodiments. While the crimping apparatus 10 is illustrated as being an applicator, other types of crimping apparatus may be used such as a leadmaker machine, a handheld pressing tool, and the like.

The base 13 and the ram 14 each carry a mating half of crimp tooling 15. The crimp tooling 15 includes an anvil 16, which represents a fixed component of the crimp tooling 15 that is removably attached to a base plate 17. The crimp tooling 15 includes a crimper 18, which represents a movable component of the crimp tooling 15, and is removably attached to the ram 14. Optionally, the base plate 17 may be coupled to the base 13 in a manner that will permit vertical movement of the plate 17. For example, an adjustment mechanism, such as an adjusting screw, may be used to adjust a vertical position of the base plate 17. FIG. 1 shows a typical terminal 20 crimped onto a wire 22. Many different types and sizes of terminals 20 and wires 22 may be used with the crimping apparatus 10. The crimp tooling 15 is used to terminate the terminal 20 to the wire 22. For example, the crimper 18 is driven along a crimp stroke initially towards the anvil 16 and finally away from the anvil 16. During the initial part of the crimp stroke, the crimper 18 engages the terminal 20 and crimps the terminal 20 onto the wire 22.

In an exemplary embodiment, a force sensor 24 is attached to the anvil 16, such as by epoxy or other adhesive. The force sensor 24 may be of any type, such as a load cell, piezoelectric sensor, a strain gauge, and the like. A pair of leads 26 carries a signal that is proportional to the stress placed on the anvil 16. The stress is transferred to the anvil 16 from the ram 14 and through the terminal 20 and wire 22 being crimped. The signal appearing on the leads 26 is indicative of the force imposed upon the terminal 20 during crimping. Optionally, rather than using the leads 26, the signal may be transmitted wirelessly or otherwise.

In an exemplary embodiment, a linear distance sensor 30 is arranged to measure the position of the ram 14 with respect to the base 13. The distance sensor 30 includes a stator 32, which is rigidly attached to the base 13 by a suitable bracket 34, and an armature (not shown) which is movable within the stator 32 in the vertical direction along the crimp stroke. A push rod 36 projects upwardly from the stator 32 and has one end attached to the movable armature and the other end adjustably attached to the ram 14 by means of a suitable bracket 38 and adjusting nut 40. Other types and configurations of distance sensors may be utilized in alternative embodiments. A pair of leads 42 carries a signal that is proportional to the vertical position of the armature within the stator 32. This signal is indicative of the vertical distance between the anvil 16 and the crimper 18 at the bottom of the stroke. Optionally, rather than using the leads 42, the signal may be transmitted wirelessly or otherwise.

By monitoring the signals on the leads 26 and 42, the quality of the crimp may be monitored. For example, the crimp height of the crimped terminal 20 can be determined, such as by analyzing the signals from the leads 42 associated with the distance sensor 30. Alternatively, the variation in the crimp height from a baseline may be determined for the crimped terminal 20. Additionally, the signal from the leads 42 may be indicative of the amount of deformation of the terminal being crimped by the anvil 16 and the crimper 18.

By analyzing the signals from the leads 26, other characteristics of the crimp may be analyzed. For example, characteristics relating to the forces imported onto the terminal 20 may be analyzed. Force data may be gathered and used to determine crimp quality. For example, a force profile may be generated and analyzed, such as to analyze parameters like the peak force exerted on the terminal 20 and the amount of work performed to complete the crimp.

In an exemplary embodiment, the force data and/or the force profile is utilized to generate frequency data and/or a frequency profile. For example, a frequency transform algorithm is used to generate frequency data to populate the frequency profile. Optionally, a Fast Fourier Transform algorithm may be utilized. Alternatively, other transform algorithms, mathematical equations, or software programs may use the force data, or other data, to extract meaningful frequency data. Optionally, the force data may be used with other data to generate frequency data. For example, data relating to time (e.g. data taken at particular sample times) or position of the crimp tooling 15 (e.g. data taken at particular crimp tooling 15 positions) may be used with the force data to create the frequency data. By transferring the force, time and/or position data to the frequency domain by focusing on particular component spatial frequencies, the data may be used in a different way to monitor the crimp quality.

The method and apparatus for measuring force and ram displacement, generating the respective signals on the leads 26 and 42, and transforming the data into the frequency domain, is by way of example only. Any suitable devices that are well known in the art may be utilized for these functions. For example, in place of the sensor 30, permanent magnets may be associated with the ram and a Hall Effect device may be attached to the base and arranged to sense the relative position of the magnets. Other suitable devices for sensing and signaling force and ram displacement may advantageously be applied to practice with the crimping apparatus 10.

Figure 2:
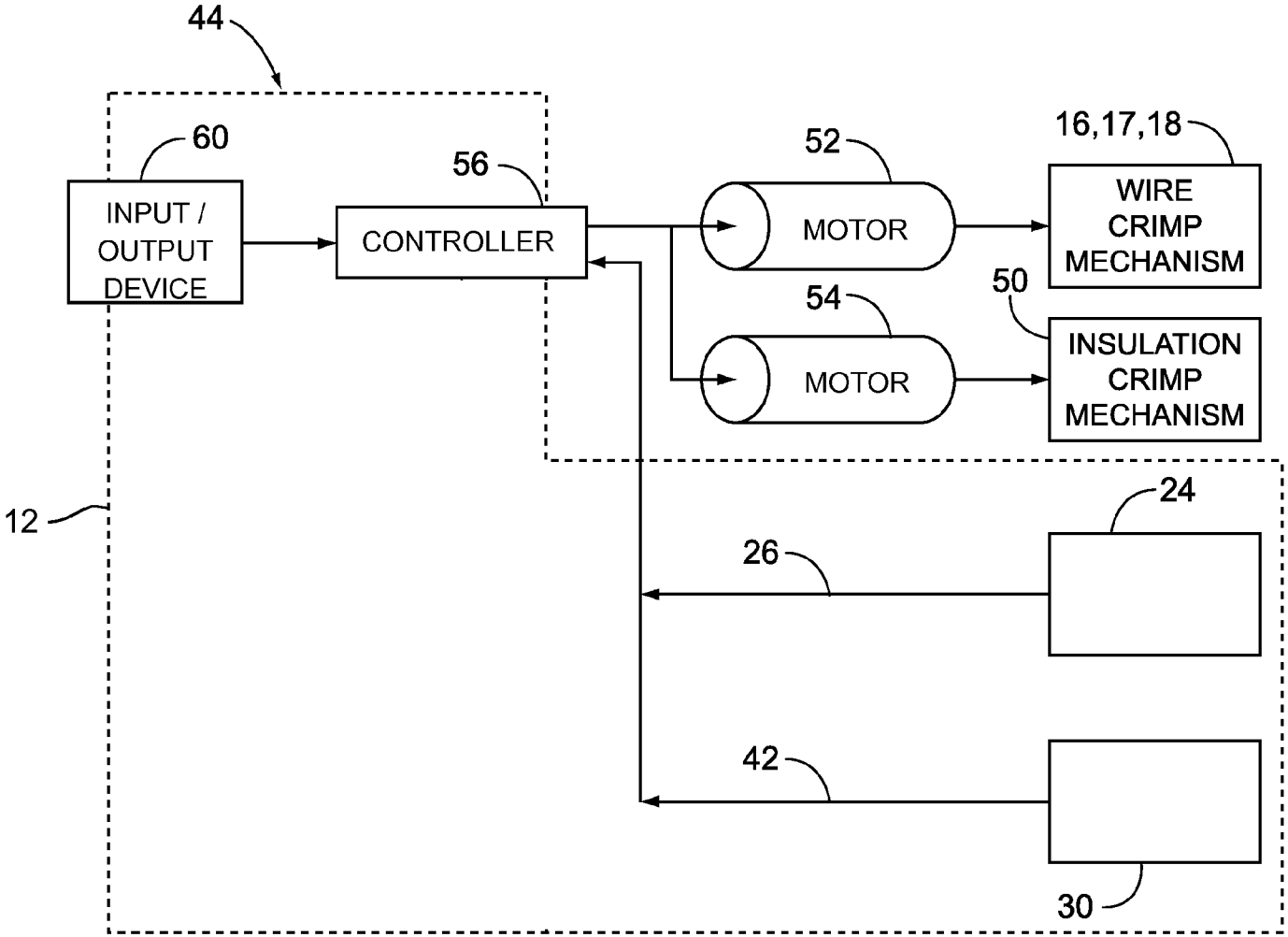
FIG. 2 is a block diagram illustrating the control system for the crimping apparatus.

FIG. 2 is a block diagram illustrating a control system 44 for the crimping apparatus 10. The crimp quality monitoring system 12 forms part of the control system 44. The wire crimping mechanism is identified as 16, 18 and 17 which represent the anvil, crimper, and movable base plate respectively. The force and linear distance sensors 24, 30 are illustrated in FIG. 2. An insulation crimping mechanism 50 is shown in FIG. 2 as an example of other instrumentalities that may be controlled in a manner similar to that of the wire crimping mechanism. Other similar instrumentalities may also be controlled in a similar way. The actual adjusting means which physically moves or adjusts the base plate 17, in the case of the wire crimp mechanism, or another adjustable device in the case of the insulation crimp mechanism, are driven by motors 52 and 54, respectively. Any suitable actuator which can be driven through a computer input/output channel may be used as the motors 52 and 54, such as servomotors, stepper motors, and the like.

A controller 56, having an input/output device 60 for operator or external communication, is arranged to drive the motors 52 and 54. The controller may have an internal memory or database for storing data, or alternatively, an external database or memory may be provided. The controller 56 may be used to drive other components, such as an ejector (not shown) that discards leads that have terminals with poor quality crimps. The controller 56 may be used to drive the crimp motor driving ram 14 (shown in FIG. 1) through the crimp stroke. The controller 56 may drive the components automatically as part of a control scheme or based on operator input through the device 60 and/or input from either the force sensor 24 or the ram position sensor 30.

The crimp quality monitoring system 12 generally includes the controller 56, the sensors 24, 30, and the input/output device 60. The crimp quality monitoring system 12 may include other components as well in alternative embodiments. Optionally, the controller 56 and/or the input/output device 60 may be part of a computer. The controller 56 may have a microprocessor for processing the signals from the sensors 24, 30, and the input/output device 60. Optionally, the input/output device 60 may be any type of device that communicates with the controller 56, such as a pointer device, a keyboard, a keypad, a computer, a portable electronic device, a monitor, and the like. The crimp quality monitoring system 12, using the controller 56, analyzes and/or manipulates the data from the sensors 24, 30 and/or the input/output device 60 to monitor crimp quality.

The signal appearing on the leads 26, which is indicative of the force imposed upon the terminal 20, and the signal appearing on the leads 42, which is indicative of the relative position of the mating halves of the crimp tooling 15, are monitored by the controller 56 and recorded. The signals may be recorded as pairs of data elements, one pair for each discrete increment of time during the crimping cycle. As such, each force unit is associated with a particular time component and a particular position component of the crimp tooling 15.

In operation, after the start of the crimp stroke is detected, as for example, by detecting a predetermined change in the position signal on the leads 42, the signals on the leads 26 and 42 are sampled every two hundred microseconds during a one hundred millisecond interval. This provides a sample rate of five thousand samples per second, for a total of five hundred measurements per crimping cycle. The one hundred millisecond measuring interval is more than sufficient to cover an entire crimp cycle of the crimp stroke.

Figure 3:
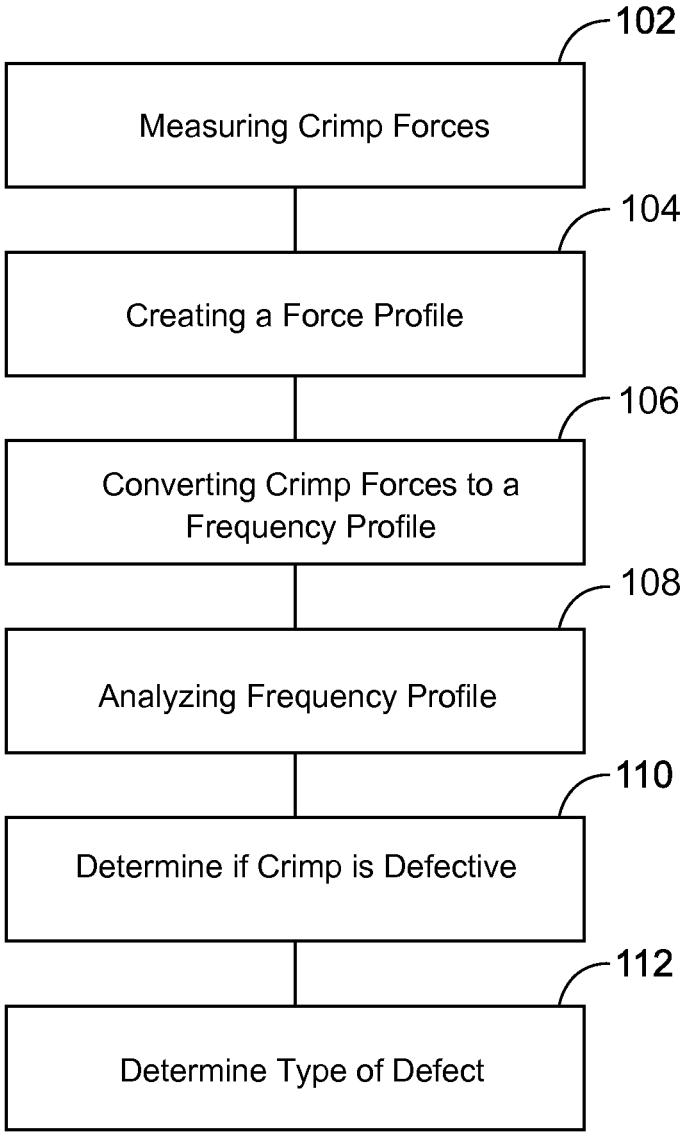
FIG. 3 is a flowchart illustrating an exemplary method of monitoring crimp quality using the crimp quality monitoring system shown in FIG. 1.

FIG. 3 is a flowchart illustrating an exemplary method of monitoring crimp quality using the crimp quality monitoring system 12 (shown in FIG. 1). The method generally includes using crimp forces to create a frequency profile using a frequency transform algorithm, and analyzing the frequency profile to determine a crimp quality.

In an exemplary embodiment, the crimp forces are measured 102 during the crimp stroke by the force sensor 24 (shown and FIG. 1). The crimp forces are measured at predetermined intervals based on either time or crimp tooling position. For example, a predetermined sample time may be selected, and the crimp force may be measured at each of the discrete sample times. Alternatively, or additionally, the crimp forces may be measured when the crimp tooling 15 (shown in FIG. 1) is at a predetermined crimp height position. The position of the crimp tooling 15 may be detected by the distance sensor 30 (shown in FIG. 1).

Optionally, the controller 56 (shown in FIG. 1) may be used to create 104 a force profile based on the measured crimp forces. The force profile may be used by the controller 56 to monitor crimp quality. For example, the force profile may be analyzed to determine if a particular crimp is defective. Data relating to the force magnitude, the peak force, the amount of area below the force curve, the shape of the force curve, and the like may be analyzed to determine if the crimp is defective. Some measurements and/or statistical noise errors may be present with the force profile. Optionally, the controller 56 may transform and decompose the force crimp signature curve into component frequencies using a transform method or algorithm. The data may thus be viewed and analyzed in an alternative way by extracting meaningful information for crimp quality from the force crimp frequency profile.

In an exemplary embodiment, the measured crimp forces and/or the force profile may be used to create the frequency profile. For example, the frequency transform algorithm may be used to convert 106 the crimp forces and/or the force profile to the frequency profile. The frequency transform algorithm may be a mathematical transformation that converts the crimp force amplitude sampled at discrete times or crimper positions to force amplitudes at discrete frequencies. Optionally, the frequency transform algorithm may be a Fourier Transform algorithm, such as the Fast Fourier Transform algorithm. The Fast Fourier Transform algorithm is a computationally efficient algorithm for computing a discrete Fourier Transform for a signal with the power of two number of samples at fixed intervals of time or position. Other transform methods may be used rather than the Fast Fourier Transform to transform the force signals into the frequency components. The controller 56 may be used to convert 106 the data to the frequency domain. Alternatively, a separate component may be used to transform the force data to the frequency data.

Once the frequency profile is created, the frequency profile may be analyzed 108. Optionally, the controller 56 may be used to analyze 108 the frequency profile. For example, the characteristics of the frequency profile may be analyzed 108 to determine 110 if a particular crimp is defective. The characteristics of the frequency profile may be analyzed 108 to determine 112 the type of defect. In an exemplary embodiment, the frequencies of the measured crimp are compared to a target crimp. The controller 56 may use a statistical approach to determine if a given force frequency profile is significantly different from the learned mean and standard deviation from the normal crimps. When the measured frequencies fall outside of the target frequencies, the crimp may be defective. Optionally, when a preset number of frequencies fall outside a target or normal range of values for the frequencies, the crimp is determined to be a defective crimp. For example, if four or more frequencies are out of range of the target frequencies, the crimp is defective. In an exemplary embodiment, depending on the frequencies that are out of range of the target frequencies, the type of defect may be determined. For example, when the controller 56 analyzes the frequencies, the controller 56 may give an indication of what type of abnormality likely caused the defective crimp. When lower frequencies are decreased in magnitude, the likely cause of the defect may be reduced material in the crimp caused by missing strands or short brush defects. When higher frequencies are reduced, the defect is likely to be insulation in the wire barrel.

Figure 4:
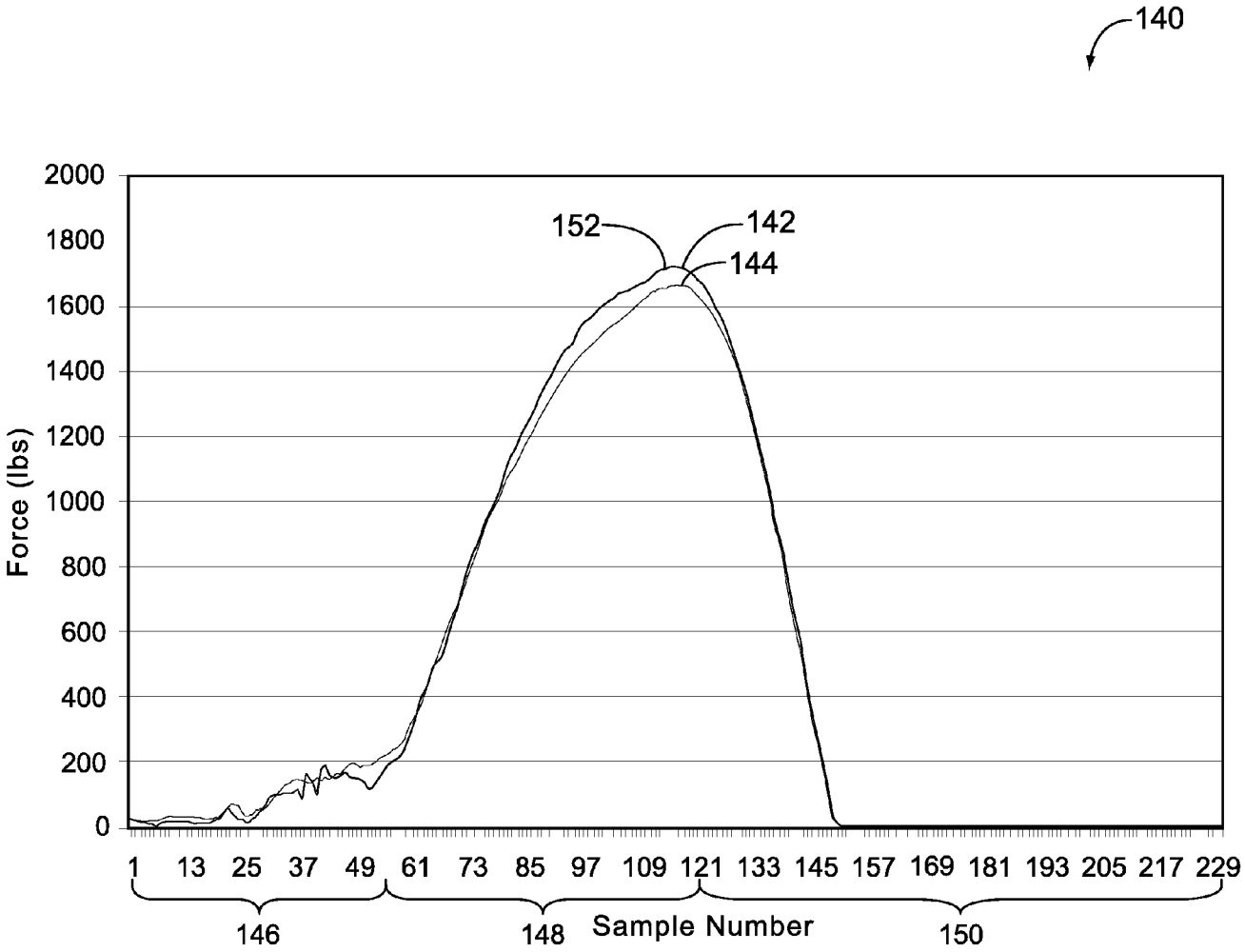
FIG. 4 is a graph showing an exemplary force profile generated by the crimp quality monitoring system shown in FIG. 1.

FIG. 4 is a graph showing an exemplary force profile 140 generated by the crimp quality monitoring system 12 (shown in FIG. 1). The force profile 140 plots the force versus a sample number. In the illustrated embodiment, the force is represented by pounds, and the interval is represented by a sample number based on time. Alternatively, the interval may be represented by a sample number based on crimp tooling position.

In the example illustrated in FIG. 4, a normal, or target, crimp curve 142 and a sample crimp curve 144 for a sample crimp that is defective are illustrated. The sample curve 144 represents a crimp force curve during a crimp having insulation extending into the wire barrel. The curves 142, 144 include an initial crimp portion 146, an intermediate crimp portion 148, and a final crimp portion 150. The initial crimp portion 146 represents a portion of the crimp in which the crimper 18 engages the terminal 20 and initially drives the terminal 20 around the wire 22. The intermediate crimp portion 148 represents a portion of the crimp in which the crimper 18 forms the terminal barrel around the wire 22. The intermediate crimp portion 148 extends to a peak 152. The final crimp portion 150 represents a portion of the crimp in which the crimper 18 finishes the crimp of the terminal barrel to the wire 22. The final crimp portion 150 extends from the peak 152 to a position corresponding to the end of the crimp.

The force profile 140 may be analyzed to determine if the crimp is defective. The force profile 140 may be analyzed to determine the type of defect, if any. If the curve is determined to have any irregularities in the sample crimp curve 144, as compared to the target curve 142, the lead may be discarded. In the illustrated embodiment, the initial crimp position 146 of the sample crimp curve 144 has a flattened area, as opposed to the oscillations found in the normal curve 142. The flattened area is caused by the insulation in the wire barrel. However, because the sample crimp curve 144 generally follows the normal curve 142, the controller 56 may not identify the crimp as defective by merely analyzing the force profile. For example, because the area under the curve is only slightly affected by the flattened area, the controller 56 may not be able to identify the defect. However, as will be described below, the analysis of the frequency profile may identify the defect.

Figure 5:
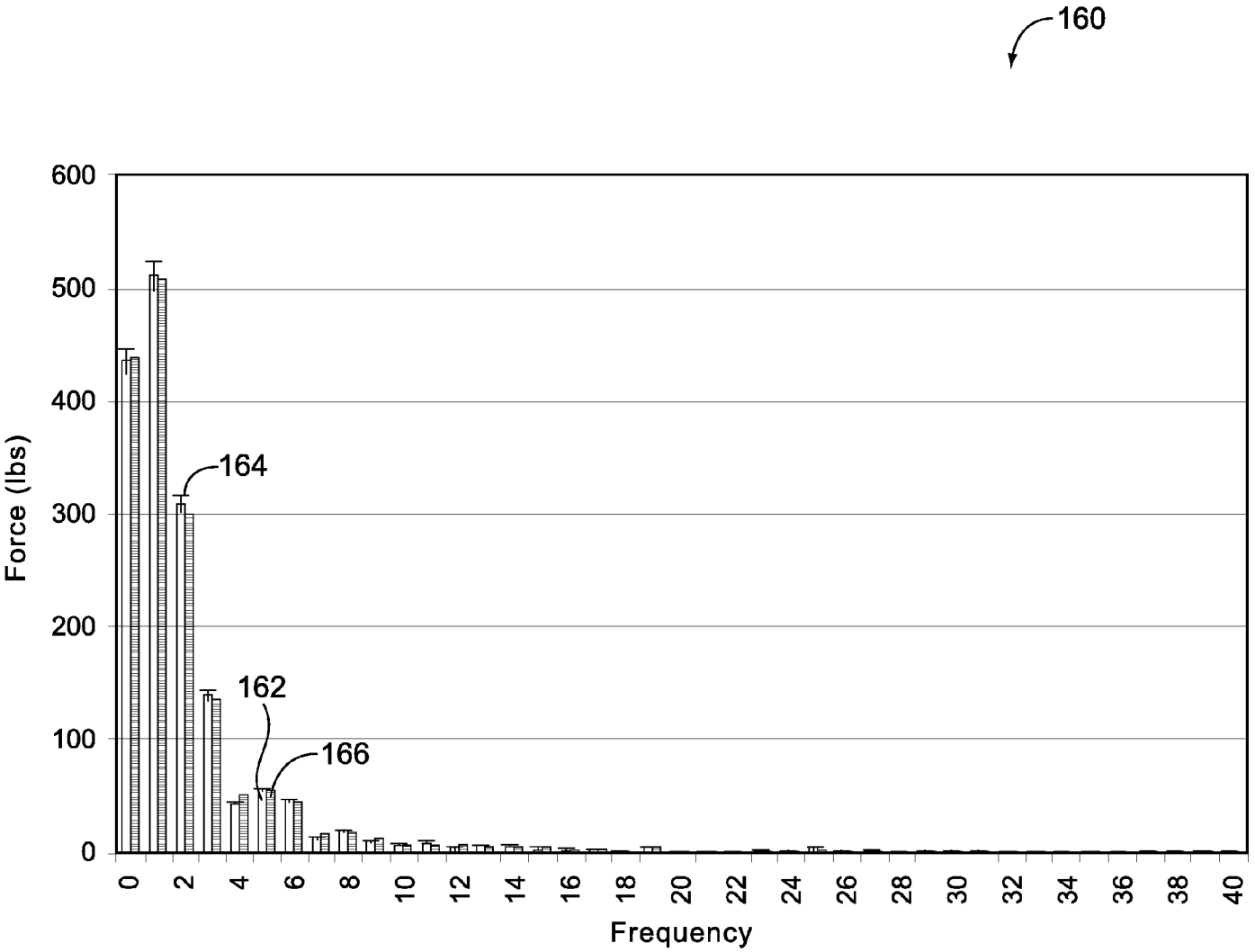
FIG. 5 is a graph showing an exemplary frequency profile generated by the crimp quality monitoring system shown in FIG. 1.

In an exemplary embodiment, the force profile 140 may be converted to a frequency profile, such as the frequency profile 160 illustrated in FIG. 5. Optionally, the underlying data populating the force profile 140 may be used to populate or generate the frequency profile. Analysis of both the force profile 140 and the frequency profile 160 may be utilized to determine if the crimp is defective and/or the type of defect. Alternatively, the controller may only analyze the force profile 140 or the frequency profile 160 to determine if the crimp is defective and/or the type of defect.

Figure 6:
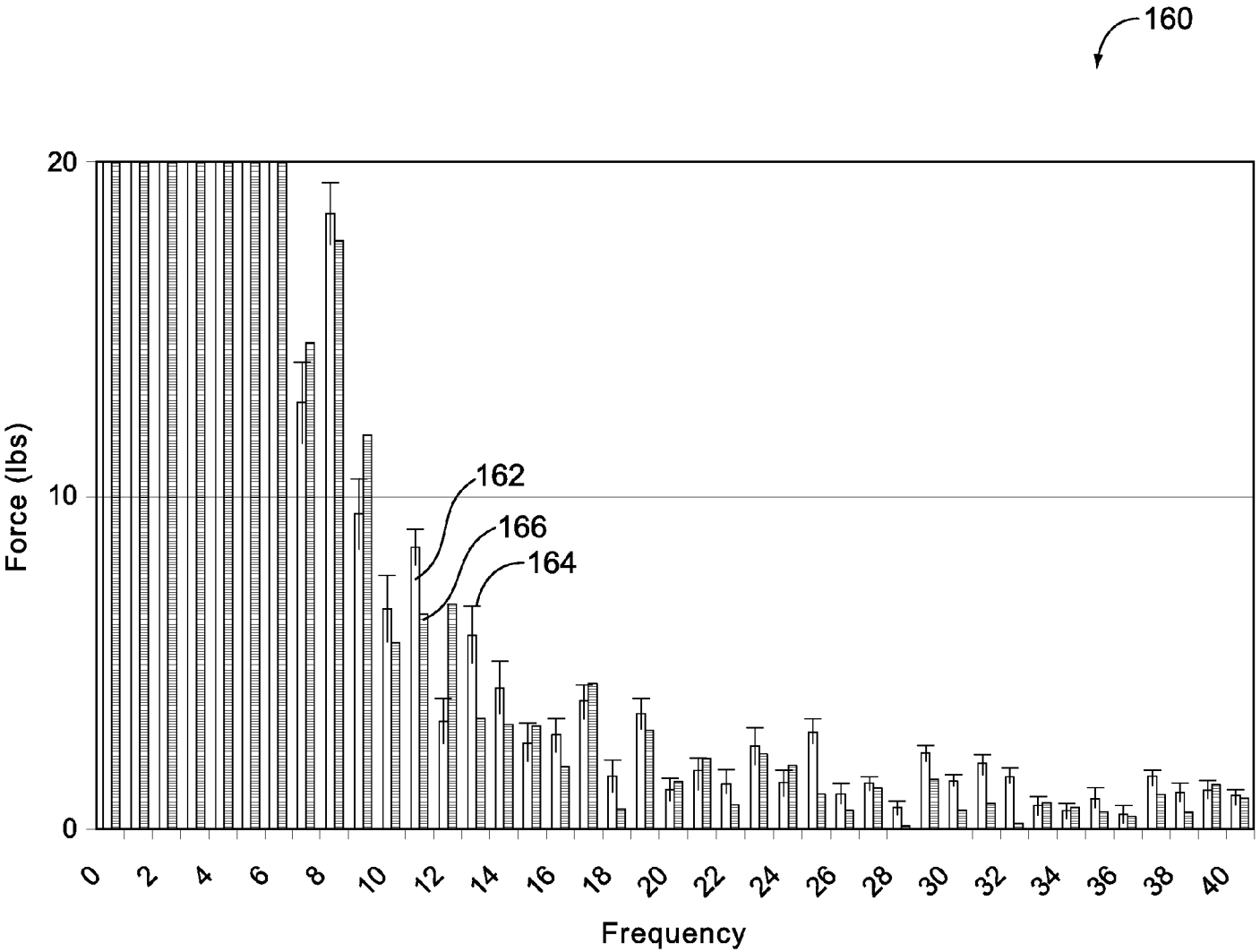
FIG. 6 illustrates a portion of the graph shown in FIG. 5.

FIGS. 5 and 6 are graphs showing an exemplary frequency profile 160 generated by the crimp quality monitoring system 12 (shown in FIG. 1) from the force profile 140 (shown in FIG. 4). FIG. 5 illustrates the entire frequency profile 160. FIG. 6 illustrates a portion of the graph shown in FIG. 5 showing a smaller amplitude of force values. FIGS. 5 and 6 are frequency histograms.

The frequency profile 160 plots force data versus frequency. FIGS. 5 and 6 illustrate a normal, or target, frequency 162 for each frequency bin or interval, as well as a frequency band 164 which shows a range of acceptable frequency values for each frequency. Optionally, the frequency band 164 may represent a confidence interval. The frequency band 164 may be a $3\sigma$ statistical band (where $\sigma$ is the standard deviation), where nearly all values lie within 3 standard deviations of the mean. FIGS. 5 and 6 also illustrate the sample crimp frequency 166 for each of the frequency intervals. If the sample crimp frequency 166 falls outside of the frequency band 164 for the corresponding frequency interval, the crimp may be defective. Optionally, the controller 56, or other program analyzing the frequency profile 160, may determine that the crimp is defective when a preselected number of the frequencies 166 fall outside of the corresponding frequency bands 164. For example, if four or more of the frequencies 166 fall outside of the frequency bands 164, then the crimp is determined to be defective.

In the illustrated embodiment, as noted above, the sample crimp represents a defective crimp in that the crimp has insulation in the wire barrel. As shown in FIG. 5, the higher amplitude, lower frequency histogram bands are largely unaffected by the insulation in the wire barrel. However, with reference to FIG. 6 which shows the lower amplitude higher frequency histogram frequencies, some of the frequencies, such as frequencies 25 and 29-32, are well below the $3\sigma$ frequency band 164 for the normal crimp. It is realized that different frequencies may be affected differently based on the type of defect. When the higher frequencies, such as those between frequencies 16 and 32, are reduced, the defect is likely to be insulation in the wire barrel. For example, the higher frequencies tend to be reduced if the force profile curve has less variation and/or is smoother (e.g. if insulation is in the wire barrel). However, when the lower frequencies, such as those between frequencies 0 and 6, are reduced, the defect is likely caused by reduced material in the crimp caused by missing strands or short brush defects. For example, the lower frequencies tend to be reduced if the average force and/or peak force of the force profile curve is lower or less (e.g. with short brush or missing strand types of defects). When the lower frequencies are elevated, the defect is likely caused by increased material in the crimp, such as by using the wrong terminal or wire size. Other types of defects may be monitored for and detected by analyzing the frequency profile and by determining which frequencies in the sample crimp are different from the normal crimp. For example, defects such as the wrong terminal or wire size, missing strands of wire, short brush, insulation in the crimp, abnormal position of the terminal, wrong wire type, incorrect stripping of insulation and the like may be analyzed. Different frequencies may be affected differently based on the type of defect.

In an exemplary embodiment, depending on the type of defect being monitored for and/or the type and size of the terminal and wire, the crimp quality monitoring system 12 (shown in FIG. 1) may only analyze the data from a subset of the frequencies. For example, rather than analyzing the data from all of the frequencies (e.g. frequencies 0-128), the current quality monitoring system 12 may merely analyze the data from frequencies 0-36, filtering the force profile by removing higher frequencies from the analysis. As a result, the amount of data analyzed by the controller 56 may be reduced which will reduce the computation time of the controller 56.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A method of monitoring crimp quality, the method comprising:

measuring crimp forces during a crimp stroke;

converting the crimp forces to a frequency profile using a frequency transform algorithm; and analyzing different predetermined subsets of frequencies of the frequency profile to determine a crimp quality, the analyzing includes determining if a crimp is defective based on the analysis of the frequency profile and determining different types of crimp defects of the crimp based on the analysis of the frequency profile.

2. The method of claim 1, wherein the measuring includes measuring crimp forces at predetermined intervals based on either time or crimp tooling position.

3. The method of claim 1, further comprising creating a force profile based on the measured crimp forces, wherein said converting comprises converting the force profile to the frequency profile.

4. The method of claim 1, wherein the converting includes converting the crimp forces to a frequency profile using a Fast Fourier Transform algorithm.

5. The method of claim 1, wherein the analyzing includes determining if more than a pre-selected number of frequencies are outside of the normal range of values for the respective frequencies.

6. The method of claim 1, further comprising creating a force profile based on the measured crimp forces, said converting comprises converting the force profile to the frequency profile, said analyzing comprises analyzing said force profile and said frequency profile to determine the crimp quality.

7. A method of monitoring crimp quality, the method comprising:

measuring crimp forces during a crimp stroke;

creating a force profile based on the measured crimp forces;

creating a frequency profile based on the measured crimp forces; and analyzing the force profile and analyzing different predetermined subsets of frequencies of the frequency profile to determine a crimp quality, the analyzing includes determining if a crimp is defective based on the analysis of the force profile and determining a type of defect of the crimp based on the analysis of the force profile, and the analyzing includes determining if a crimp is defective based on the analysis of the frequency profile and determining different types of crimp defects of the crimp based on the analysis of the frequency profile.

8. The method of claim 7, wherein said creating a frequency profile comprises converting the force profile to a frequency profile using a frequency transform algorithm.

9. The method of claim 7, wherein said creating a frequency profile comprises converting the crimp forces to a frequency profile using a Fast Fourier Transform algorithm.

10. The method of claim 7, wherein the measuring includes measuring crimp forces at predetermined intervals based on either time or crimp tooling position.

11. The method of claim 7, wherein the analyzing includes determining if more than a pre-selected number of frequencies are outside of the normal range of values for the respective frequencies.

* * * * *